United States Patent [19]

Kortye

[11] 4,325,481

[45] Apr. 20, 1982

[54] ANCHOR PLATE

[76] Inventor: Heinrich Kortye, 930 NE. 50th Ct., Pompano Beach, Fla. 33064

[21] Appl. No.: 223,344

[22] Filed: Jan. 8, 1981

[51] Int. Cl.[3] ..... B65D 21/02; B65G 1/14

[52] U.S. Cl. ..... 206/503; 206/504; 206/821; 410/155

[58] Field of Search ..... 206/499, 502, 503, 504, 206/585, 821; 410/155, 120; 229/DIG. 11

[56] References Cited

U.S. PATENT DOCUMENTS

| | | | |
|---|---|---|---|
| 1,514,512 | 11/1924 | Fisher | 410/155 |
| 1,519,901 | 12/1924 | Boaz et al. | 206/821 |
| 1,638,612 | 8/1927 | Baus | 410/120 |
| 1,953,303 | 4/1934 | Kohlmann | 206/499 |
| 2,120,610 | 6/1938 | Howard | 206/821 |
| 2,851,188 | 9/1958 | Pavelle | 206/502 |
| 2,905,114 | 9/1959 | Olson | 206/585 |
| 3,250,564 | 5/1966 | Stern et al. | 206/821 |
| 3,369,676 | 2/1968 | Swetnam | 206/504 |
| 3,580,186 | 5/1971 | Pierce | 410/155 |
| 4,069,927 | 1/1978 | Taylor | 206/821 |
| 4,161,254 | 7/1979 | Taylor | 206/504 |

*Primary Examiner*—George E. Lowrance
*Attorney, Agent, or Firm*—Malin & Haley

[57] ABSTRACT

A new and improved anchor plate for maintaining stacked containers in a stable relation. The anchor plate includes a substantially rigid body for placement between adjacent containers, the body having a plurality of corrugated patterns formed therein, each corrugated pattern having a raised side with a plurality of rows of teeth extending from the raised side for engaging the adjacent containers. The corrugated pattern enhances the penetrating capability of the plate and yet prevents total penetration of the teeth through the entire thickness of the material of the container.

3 Claims, 4 Drawing Figures

ANCHOR PLATE

BACKGROUND OF THE INVENTION

The present invention relates to anchoring devices for maintaining stach containers in stable relation and more particularly to an improved anchor plate having a plurality of corrugated patterns with teeth extending from the raised portion of the corrugated pattern to improve the penetration of the teeth into the container material, without fully penetrating the container.

In the past, there have been various anchor members for unitizing a plurality of containers. In U.S. Pat. No. 4,161,254, there is disclosed an anchor member for unitizing containers by having a single wall portion extending from the anchor member transversely of one face which is adopted to be positioned in the space between laterally adjacent containers, and also includes pins or teeth extending from both faces of the body for gripping or engaging the walls of the adjacent or superimposed containers. The anchor member includes a flat body from which the teeth extend. U.S. Pat. No. 3,369,676, discloses an anchoring device having a pair of plate portions formed of sheet metal having a plurality of interval clawa extending from each major surface and interconnecting portion of reduced width with respect to the plate portion for normally maintaining the plate portion in a generally common plane and being bendable without separation. Again a flat plate is used. However, the use of a flat plate presents a problem in that depending on the flexibility of the containers being interconnected, sometimes all of the holding teeth do not penetrate the container material.

The present invention overcomes the aforesaid problems by providing a plurality of corrugated patterns in the plate with the teeth extending from the raised sides of corrugated patterns making penetration of the teeth into the container material more likely even though the container material may be somewhat flexible.

SUMMARY OF THE INVENTION

According to the present invention an improved anchor plate for maintaining stacked containers in stable relation is presented. The anchor plate includes a substantially rigid body for placement between adjacent containers, the body having a plurality of corrugated patterns formed therein, each said corrugated pattern having a raised side with a plurality of rows of teeth extending from the raised side of each corrugated pattern for engaging adjacent containers.

The anchor plate is simply placed on the abutting side of a stacked container prior to adding another stacked container, the weight of the next placed container causing penetration of the teeth into both of the adjacent containers. The corrugated pattern ensures that a greater number of the teeth will penetrate the container material, without extending all the way through the container material.

It is therefore an object of this invention to provide a new and improved anchor plate for maintaining stacked containers in a stable relation which provide a corrugated pattern having raised sides with teeth protuding from the raised side to ensure greater penetrating ability of the teeth into the container material.

It is another object of this invention to provide a new and improved anchor plate which enhances the gripping characteristics of the teeth within the stack container material.

DESCRIPTION OF THE PREFERRED EMBODIMENT

Figure 1:
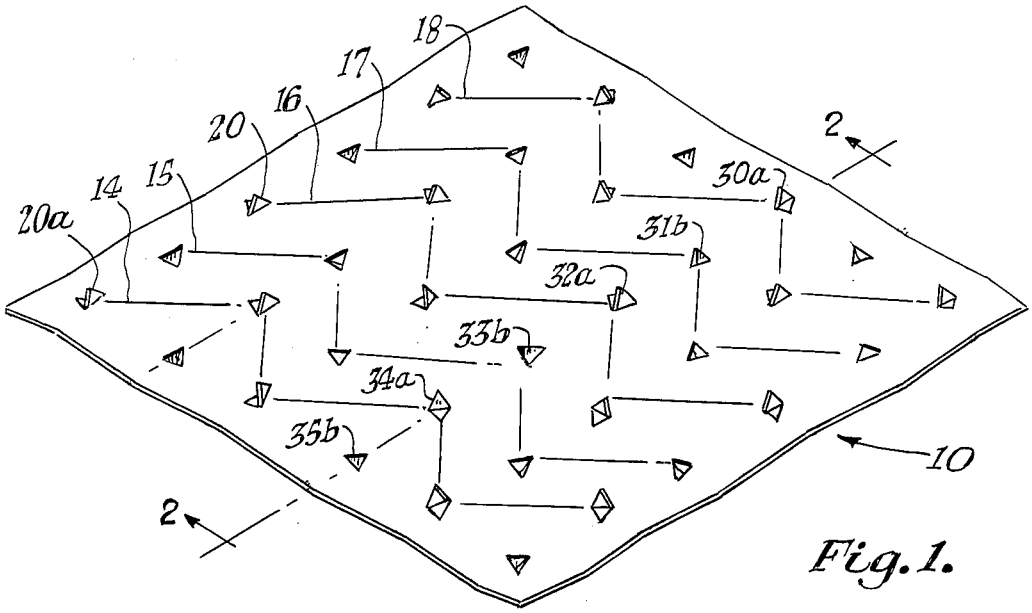
FIG. 1 is a perspective view of the present invention.
Figure 2:
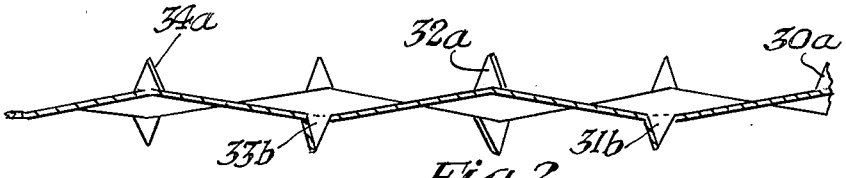
FIG. 2 is a cross sectional view of FIG. 1 taken across the line 2—2 and looking in the direction of the arrows.

Referring now to the drawings and more particularly to FIG. 1, the present invention is shown generally at 10 and comprises a substantially rigid body 12, preferably made of a thin metallic material, the body 12 including a plurality of corrugated zig-zag patterns 14, 15, 16, 17, and 18 with a plurality of teeth 20 formed from the body material protruding transversely of the body 12. The body 12 with the corrogations is flexible and may be compressed into a flat plane. The corrugated zig-zag patterns are designed such when progressing from pattern 14 to pattern 18 the even numbered zig-zag patterns have their raised side on the top face of the plate and the odd numbered zig-zag patterns have their raised side protruding from the bottom face of the plate. The teeth 20 are punched in the plate in a random orentation pattern so that they protrude from the raised side of the respective zig-zag pattern from which they are stamped. Therefore when progressing either longitudinally or laterally along the plate, the teeth 20 alternately protrude from the top face and bottom face of the plate as shown in FIG. 1. More specifically, the first tooth in zig-zag pattern 14 for example tooth **34*a* is protruding from the top face of the plate, the first tooth for example 33*b* in zig-zag pattern 15 is protruding from the bottom of the plate, at cetera, as shown more clearly in FIG. 2**.

Figure 3:
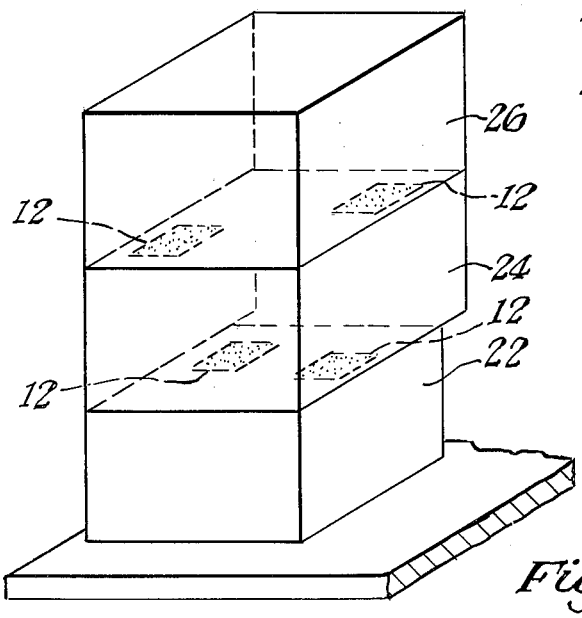
FIG. 3 is a phantom view of the present invention since they are used to stack containers.
Figure 4:
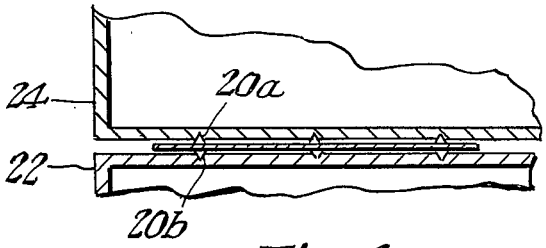
FIG. 4 is a partial side view of FIG. 3 showing the anchor plate in position between adjacent containers.

Referring now to FIGS. 3 and 4 the anchor plate 12 is shown in use to maintain the stacked containers 22, 24 and 26 in stable relation. As shown in FIG. 4, the raised sides of the corrugated patterns bias the plurality of teeth **20*a* and 20*b* in such a manner to enhance the penetration of the aforesaid teeth in the container material 22 and 24, yet ensuring that the teeth 20*a* and 20*b* do not penetrate through the entire thickness of the containers 22 and 24 thereby preserving the contents of the container. The plate 10 may be placed on the corner for adjacent boxes with 4** boxes placed on top of the four lower boxes.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A new and improved anchor plate for maintaining stacked containers in a stable relation, comprising:

a substantially rigid body for placement between adjacent containers;

said body having a plurality of patterns formed therein, said patterns providing a resilient hill and dale surface, a plurality of rows of teeth on the upper portion of said hill surface for engaging said adjacent containers and a plurality of rows of teeth on the lower portion of said dale surface extending downward for engaging said adjacent container.

2. A new and improved anchor plate as set forth in claim 1, wherein:

said rows of teeth formed from triangular punched out areas of said body, said triangular punched out areas randomly oriented to provide greater stability of stacked boxes in all directions.

3. A new and improved anchor plate as set forth in claim 2, wherein:

said patterns and said hill and dale surface provided a biasing force for moving each tooth further into the adjacent containers and for moving each tooth with the container as it shifts during transportation.

* * * * *